United States Patent [19]

Yamagishi et al.

[11] Patent Number: 5,069,944

[45] Date of Patent: Dec. 3, 1991

[54] THERMAL TRANSFER RECORD SHEET

[75] Inventors: Takashi Yamagishi, Yokohama; Yukito Yamamoto; Yoji Murakami, both of Sagamihara, all of Japan

[73] Assignee: Teijin Limited, Osaka, Japan

[21] Appl. No.: 493,784

[22] Filed: Mar. 15, 1990

Related U.S. Application Data

[62] Division of Ser. No. 412,125, Sep. 25, 1989, Pat. No. 4,937,224.

[30] Foreign Application Priority Data

Sep. 29, 1988 [JP] Japan ..... 63-242557
Jul. 7, 1989 [JP] Japan ..... 1-174115

[51] Int. Cl.[5] ..... B41M 3/12; B41M 5/035; B41M 5/26

[52] U.S. Cl. ..... 427/444; 8/471; 427/333; 427/388.2; 427/146; 428/195; 428/423.1; 428/482; 428/913; 428/914; 503/227

[58] Field of Search ..... 8/471; 427/146, 333, 427/388.2, 444; 428/195, 423.1, 482, 913, 914; 503/227

[56] References Cited

PUBLICATIONS

"Encyclopedia of Polymer Science and Technology", vol. 2, pp. 506–516 (1969).

*Primary Examiner*—Bruce H. Hess
*Attorney, Agent, or Firm*—Sherman and Shalloway

[57] ABSTRACT

A thermal transfer record sheet comprising a substrate sheet and a dye receptive layer and a non-tacky layer in this order on at least one surface of the substrate sheet; the dye receptive layer being composed of a crosslinking reaction product of a composition comprising (A-1) a saturated polyester containing units derived from 2,2-bis(4-hydroxyphenyl)propane in the main chain of the polyester and having a glass transition temperature of at least 60° C. and (A-2) a polyisocyanate compound, and the non-tacky layer (B-1) comprising a water-insoluble or sparingly water-soluble fluorine-containing surface-active agent and (B-2) having a thickness of 50 to 200 angstrom.

2 Claims, No Drawings

THERMAL TRANSFER RECORD SHEET

This is a division of application Ser. No. 07/412,125, filed Sept. 25, 1989, now U.S. Pat. No. 4,937,224.

This invention relates to a thermal transfer record sheet, a pre-sheet for its production, and a process for production of the record sheet. More specifically, it relates to a record sheet which has excellent sublimable dye receptivity, is free from melt-adhesion to a thermal transfer ink ribbon, and permits stable thermal transfer of an image, a pre-sheet for its production, and a process for producing the record sheet.

In recent years, with the widespread use of televisions, VTR, videodisks and personal computers as information processing terminals, and also of the method of displaying various pieces of information on a CRT display, some methods have been proposed for recording images produced on these devices as colored images. One of them is a thermal transfer recording method which has recently attracted much attention because of the ease of control by electrical signals, freedom from noises, and the ease of maintenance. This thermal transfer recording method is based on the combination of a color ink ribbon and a record sheet, and involves heating the color ink ribbon by a thermal head whose amount of heat generation is controlled by electrical signals, and transferring the heated ink to the record sheet by melting or sublimation to record information such as images. The method of thermal transfer method is either of the heat melt transfer type or the sublimation transfer type.

The heat melt transfer type uses a color ink ribbon having an ink composition comprising a dye or pigment dispersed in a thermoplastic resin, a wax, etc. The ink layer melted by the heat from the thermal head is transferred to the record sheet and solidified. The device used in this method is simple and a relatively high recording speed is obtained, but the brightness of a color image decreases owing to color mixing, and reproduction of halftones is difficult.

The sublimation transfer type uses a color ink ribbon having a coating of an ink composition comprising a mixture of a disperse dye having high sublimation stability and a binder resin. The disperse dye in the ribbon sublimes and is transferred to the record sheet by the heat from the thermal head By this method, a continuous thermal tone is easily obtained according to the thermal energy. Accordingly, by the sublimation of the dye corresponding to the thermal energy, the dye migrates and the dye molecules are transferred. Consequently, it is easy to control the quality of an halftone image, and the image has high brightness and a high density. This method, therefore, is considered to be most suitable for such applications as a videoprinter, a full color printer, a pictorial color proof and a color copier.

Japanese Laid-Open Patent Publication No. 258,790/1986 discloses a structure composed of a substrate sheet, for example a paper-like synthetic sheet, a film or a foamed sheet of a polyester, polypropylene, polystyrene or a polyamide and formed thereon a layer of a thermoplastic resin such as a copolyester, polyamide, or polystyrene having a low glass transition temperature which permits effective adsorption of a sublimable dye. However, since the temperature of the thermal head at the time of printing reaches as high as 300 to 400° C., the record sheet carrying the layer of the thermoplastic resin with a low glass transition temperature is heat-softened, and the ink ribbon and the record sheet melt-adhere to each other to cause a failure of travelling. Moreover, unusual transfer of the ink occurs to cause formation of unnecessary raised and depressed portions in the record sheet. The quality of the resulting image is therefore degraded.

In order to prevent melt adhesion owing to heat, a method was proposed in which a large amount of a granular filler such as titanium dioxide, silica, calcium carbonate or talc is added to a composition forming the dye receptive layer of the record sheet to form raisings and depressions on the surface of the dye receptive layer (Japanese Laid-Open Patent Publications Nos. 16489/1986 and 27292/1986). Even when the melt adhesion between the ink ribbon and the record sheet can be prevented by this method, these raised and depressed areas make the sublimable dye unable to be transferred stably to the record sheet. It is difficult therefore to obtain an image having a high resolution.

Likewise, to prevent melt-adhesion by heat, a record sheet is known in which a dye receptive layer having incorporated therein a highly crosslinkable heat-resistant resin such as a silicone, epoxy or melamine resin is formed (Japanese Laid-Open Patent Publication No. 127392/1986). In this record sheet, the permeation and absorption of the sublimable dye in the dye receptive layer are reduced, and it is difficult to reproduce an image having a high density.

Attempts were also made to improve the non-tackiness between the ink ribbon and the record sheet by including a slippery substance such as a fluorinated hydrocarbon, a perfluoroalkylsulfonate salt in a composition forming the dye receptive layer (see, for example, Japanese Laid-Open Patent Publications Nos. 212394/1985, 177289/1986 and 27290/1986).

There was also proposed a method in which a layer of a resin having a high surface energy, such as a silicone resin or fluorine resin is superimposed on the dye receptive layer (Japanese Laid-Open Patent Publication No. 201291/1987). Since, however, the surface layer is composed of the resin having a high surface energy, it is necessary to form the surface layer in a thickness of at least about 1 micrometer as stated in the above Publication in order to overcoat the dye receptive layer uniformly with the surface layer. Hence, the passage of the dye through the surface layer becomes difficult If, on the other hand, the thickness of the surface layer is made thinner, the resin having a high surface energy forms a sea-and-island structure or an uneven structure on the surface, and the dye receptive layer is exposed partly on the surface. It is difficult therefore to prevent the melt-adhesion of the ink ribbon to the record sheet completely, and the density of the printed image becomes non-uniform. A high-quality image is difficult to obtain.

Japanese Laid-Open Patent Publication No. 152897/1987 discloses a receptor material for a sublimation transfer-type hard copying in which at least the dye receptive layer as the uppermost layer is composed of a resin having a bisphenol skeleton, and the resin constituting the above resin layer has a glass transition point Tg of at least 55° C. This patent document states that the receptor material has excellent storage stability after the transfer.

Accordingly, it is an object of this invention to provide a thermal transfer record sheet.

Another object of this invention is to provide a record sheet which can be caused to travel stably for printing without melt-adhesion to an ink ribbon in the sublimation thermal transfer recording process.

Still another object of this invention is to provide a record sheet which permits exact transfer of an ink from an ink ribbon and exact fixation of the transferred ink, therefore gives a high printed density, and has excellent storability or durability of the resulting image.

Yet another object of this invention is to provide a record sheet which has the above excellent advantages as a result of using a substrate sheet having a smooth surface, and can raise the printing speed and gives a high resolution.

A further object of this invention is to provide a pre-sheet for the production of the record sheet of the invention, and a process for producing the presheet.

Other objects of this invention along with its advantages will become apparent from the following description.

In accordance with this invention, the above objects and advantages of the invention are achieved by a thermal transfer record sheet comprising a substrate sheet and a dye receptive layer and a non-tacky layer in this order on at least one surface of the substrate sheet; the dye receptive layer being composed of a crosslinking reaction product of a composition comprising (A-1) a saturated polyester containing units derived from 2,2-bis(4-hydroxyphenyl)propane in the main chain of the polyester and having a glass transition temperature of at least 60° C. and (A-2) a polyisocyanate compound, and the non-tacky layer (B-1) comprising a water-insoluble or sparingly water-soluble fluorine-containing surface-active agent and (B-2) having a thickness of 50 to 200 angstrom.

The saturated polyester (A-1) in the dye receptive layer forming the record sheet of the invention contains units derived from 2,2-bis(4-hydroxyphenyl)-propane in its main chain and has a glass transition temperature of at least 60° C.

Preferably, the saturated polyester is linear or substantially linear. The saturated polyester preferably has a number average molecular weight of 5,000 to 50,000. Moreover, the saturated polyester preferably contains 2.5 to 25% by weight, especially 5 to 15% by weight, of units derived from 2,2-bis(4-hydroxyphenyl)-propane, i.e. the units of the following formula

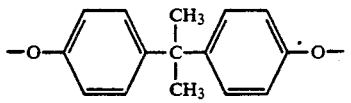

in its main chain. That the main chain of the polymer has a skeleton of 2,2-bis(4-hydroxyphenyl)propane offers advantages in respect of, for example, the permeation and exhaustion of a disperse dye, the solubility of the polymer in organic solvents, and heat resistance (high glass transition temperature). If the proportion of the units derived from 2,2-bis(4-hydroxyphenyl)propane is less than 2.5% by weight, the dye exhaustion of the disperse dye is low, and a sufficient image density is difficult to obtain. On the other hand, if it exceeds 25% by weight, the production of a polymer having a high degree of polymerization becomes difficult, and the fading of the image is remarkable. Furthermore, the fixed dye migrates greatly to impair markedly the characteristics of the record sheet.

Preferably, the saturated polyester used in this invention is produced by using at least one type of dicarboxylic acid component or at least one type of diol component, particularly at least two dicarboxylic acids or at least two diols.

Any of aromatic dicarboxylic acids and aliphatic dicarboxylic acids may be used as the dicarboxylic acid. Examples of preferred aromatic dicarboxylic acids are terephthalic acid, isophthalic acid, 2,6-naphthalenedicarboxylic acid and 4,4'-diphenyletherdicarboxylic acid. Examples of the aliphatic dicarboxylic acids are adipic acid and sebacic acid. In order to enhance the heat resistance of the polymer, it is preferred to use an aromatic dicarboxylic acid as a main ingredient of the dicarboxylic acid component.

The diol component may be any of aliphatic diols, polyalkyl ether glycols and aromatic diols.

Examples of the aliphatic glycols are ethylene glycol, tetramethylene glycol, neopentyl glycol and diethylene glycol.

Examples of the polyalkyl ether glycols are polyethylene ether glycol and polytetramethylene ether glycol.

Examples of the aromatic diols include hydroquinone, resorcinol, bisphenol S, 2,2-bis(4-hydroxyphenyl)propane, and alkylene oxide adducts of these diols [such as 2,2-bis(4-hydroxyethoxyphenyl)propane and 2,2-bis(4-hydroxypropoxyphenyl)propane.

Since the saturated polyester used in this invention contains units derived from 2,2-bis(4-hydroxyphenyl)-propane, the polymer is produced by using 2,2-bis(4-hydroxyphenyl)propane or its alkylene oxide adducts as the diol component.

The saturated polyester can be produced by a known method such as melt-polymerization or solution-polymerization. When 2,2-bis(4-hydroxyphenyl)propane is directly used as a starting material, it is preferable to employ the solution polymerization method in which it is reacted with an acid halide. When an ethylene oxide adduct of 2,2-bis(4-hydroxyphenyl)propane is used as the material, the melt-polymerization method (for example, ester-interchange method) is preferably used.

It is critical that the saturated polyester should have a glass transition temperature of at least 60° C. If its glass transition temperature is lower than 60° C., the image obtained by thermal transfer has low heat resistance and storage stability, or undergoes color migration. Furthermore, blocking of sheet surface to itself may occur, and the printed characters are liable to be blurred, obscured, or thinned at the time of thermal transfer recording.

The polyisocyanate compound (A-2) is an isocyanate having at least two isocyanate groups, and for example, diisocyanates, triisocyanates or mixtures thereof are preferred They may be aromatic or aliphatic.

Examples of the polyisocyanate compound (A-2) include p-phenylene diisocyanate, 1-chloro-2,4-phenyl diisocyanate, 2-chloro-1,4-phenyl diisocyanate, 2,4-toluenediisocyanate, 2,6-toluene diisocyanate, hexamethylene diisocyanate, 4,4'-biphenylene diisocyanate, xylene diisocyanate, m-phenylene diisocyanate and 2,4,6-triphenyl cyanurate. These isocyanates may be used as adducts with trimethylolpropane, glycerol, phenol, caprolactam, etc. Of these, toluene diisocyanate, xylylene diisocyanate and m-phenylene diisocyanate are especially preferred as the polyisocyanate compound (A-2).

The use of the polyisocyanate compound (A-2) is especially useful for preventing the color migration of the dye. Generally, when printed record sheets are stacked or wound up in roll form, the dye in the dye receptive layer gradually migrates. This phenomenon tends to occur at high temperatures and humidities. The use of the polyisocyanate compound (A-2) induces partial crosslinking of the saturated polyester (A-1) constituting the dye receptive layer, and reduces the migration of the dye.

The amount of the polyisocyanate compound (A-2) used is generally 5 to 25 parts by weight, preferably 7.5 to 15 parts by weight, per 100 parts by weight of the saturated polyester (A-1). If the amount of the polyisocyanate compound is less than 5 parts by weight, the color migration of the dye tends to increase and the long-term storage stability of the record sheet tends to be lowered. On the other hand, if it exceeds 25 parts by weight, the proportion of the polyester becomes relatively low, and a sufficient image density is difficult to obtain. Another marked effect of using the polyisocyanate compound (A-2) is that the adhesion of the dye receptive layer to the substrate sheet is not lost even at high temperatures and humidities.

As required, the dye receptive layer comprising components (A-1) and (A-2) may further include an antistatic agent, an ultraviolet absorber, an antioxidant, a fluorescent agent, a sticking-preventing agent, a wax, a filler, a matting agent or a surface tension adjusting agent.

The dye receptive layer of the record sheet of the invention is the crosslinking reaction product obtained by reacting a composition comprising the saturated polyester (A-1) and the polyisocyanate compound (A-2) on the substrate sheet.

The dye receptive layer can be formed by, for example, uniformly coating the composition on the substrate sheet in accordance with a known coating method using a reverse roll coater, a gravure coater, a Mayer bar coater, a microgravure coater, an air knife coater, a die coater or a spray coater, drying the coating, and as required, applying a radiation treatment to the coated layer using ultraviolet rays, far-infrared rays or electron beams, or allowing the coated sheet to stand for several days at a high temperature of 40 to 60° C., to solidify the coated layer.

The dye receptive layer has a thickness of preferably 1 to 6 micrometers, more preferably 1.5 to 6 micrometers, especially preferably 2.5 to 4.0 micrometers.

Since the dye receptive layer of the record sheet of this invention has the particularly high ability to fix the dye, it can give a sufficient image density when its thickness is about half of that in the prior art. This will serve to give a correspondingly clearer image. If the thickness of the dye receptive layer is less than 1.0 micrometer, a sufficient image density is difficult to obtain. If, on the other hand, it exceeds 6 micrometers, the image density cannot be increased further, and there is almost no economical advantage.

The record sheet of this invention has a non-tacky layer on the dye receptive layer.

The non-tacky layer comprises a water-insoluble or sparingly water-soluble fluorine-containing surface-active agent. The fluorine-containing surface-active agent is characterized, for example, by showing a solubility of only not more than 0.5 g in 100 g of water at 25° C. Preferably, the fluorine-containing surface-active agent has an HLB value (Hydrophile-Lipophile Balance) of less than 7.

The fluorine-containing surface-active agent is known per se and is of the structure which contains a fluorocarbon group as a hydrophobic group and a sulfonate, phosphonate, carboxylate, amine salt, polyoxyethylene or its ester, etc. as a hydrophilic group. Some fluorine-containing surface-active agents are commercially available.

Examples of the fluorine-containing surface-active agent are polyvinyl fluoride, polyvinylidene fluoride and vinyl fluoride/vinylidene copolymer having $$CF_3\text{-}(CF_2CF_2)_n\text{-},\ CF_3\text{-}(CF_2CFH)_n\text{-},\ \text{or}\ CF_3\text{-}(CFHCFH)_n\text{-}$$

as a hydrophobic group. These polymers have a degree (n) of polymerization of 2 to 20, preferably 4 to 10. Generally, with fluorine compounds having a low degree of polymerization, it is difficult to form a uniform layer having a low-energy surface and also to develop a releasing and sliding effect. Fluorine compounds having a degree of polymerization higher than 20 do not have sufficient solubility and ion dissociation of surfactants, and are not desirable.

Examples of preferred fluorine-containing surface-active agents are SURFLON® S-141, 145 (products of Asahi Glass Co., Ltd.), MEGAFAC® F-183, 184 (products of Dainippon Ink and Chemicals, Inc.), and Fluorad® FC-431 (a product of Sumitomo 3M Co., Ltd.)

In the fluorine-containing surface-active agent, the hydrophobic fluorocarbon groups form a releasing surface to be in contact with the ink ribbon, and function to prevent melt-adhesion of the record sheet to the ink ribbon, unusual transfer of the image to the record sheet, and the travelling failure of the record sheet. Moreover, the polyoxyethylene-adduct or ester group portion of the fluorine-containing surface active agent enhances compatibility between the saturated polyester resin and the surfactant at the interface between the dye receptive layer and the non-tacky layer, and serves to further strengthens the above-mentioned function.

A silicone-type surface-active agent as an additional component may be used in combination with the fluorine-containing surface-active agent in the non-tacky layer. Surface-active agents having an alkylsilicone as a hydrophobic group and a sulfonate, phosphate, carboxylate, amine salt, polyoxyethylene, its adducts, etc. as a hydrophilic group are preferably used as the silicone-type surface-active agents. These compounds are known per se, and are commercially available.

Preferred silicone-type surface-active agents are those containing hydrophobic groups such as

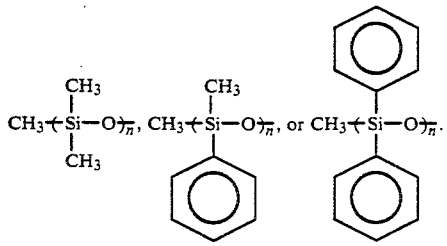

In these formulae, n is preferably 2 to 20, especially preferably 4 to 10.

Such a silicone-type surface-active agent may be used in an amount of not more than 30 parts by weight per 100 parts by weight of the fluorine-containing surface-active agent.

The thickness of the non-tacky layer is 50 to 200 angstrom.

The formation of the non-tacky layer has greatly to do with the migrability of the dye, the travelling property of the ink ribbon and the record sheet, ink transfer and melt adhesion at the time of image formation. If the thickness of the non-tacky layer is more than 200 angstrom, the migration of the dye at the time of transfer is impaired, and an image having only a low density is obtained. Further, at this time, an undesirable phenomenon occurs in which the dye fixed migrates to the interfacial part of the releasing layer having a surface-active agent type, and color migration is quickened.

On the other hand, if the thickness of the non-tacky layer is smaller than 50 angstrom, the ink ribbon melt-adheres to the record sheet at the time of image recording to make them unable to travel smoothly and properly. This is presumably because the thickness of the non-tacky layer is too small, and a sufficiently uniform, low-energy interface is not formed.

The surface of the non-tacky layer should be formed in uniform thickness and flatness. If the surface partly has a sea-and-island structure or an uneven pattern, the record sheet is liable to melt-adhere to the ink ribbon, and a high resolution is difficult to realize. Accordingly, it is desirable to form this non-tacky layer by a super-precision thin film coating method such as a method using a highly precise reverse roll coater or microgravure coater, a mist adsorption method, a migration method and a spray coating method. Moreover, the coating solution for the formation of the non-tacky layer preferably has a very low solids concentration. Usually, it is 0.1 to 0.001%, preferably 0.05 to 0.005%. The solvent used in the coating solution is of the type which does not soak the dye receptive layer beneath the non-tacky layer. Preferred solvents are, for example, n-hexane, n-heptane, ethanol, isopropyl alcohol, and chlorofluorocarbon.

According to a particularly preferred embodiment, the record sheet of this invention can also be produced by preparing a pre-sheet for preparation of a record sheet comprising a substrate sheet and on at least one surface thereof, a layer composed of the partial cross-linking reaction product of a composition comprising (A-1) a saturated polyester containing units derived from 2,2-bis(4-hydroxyphenyl)propane and having a glass transition temperature of at least 60° C., (A-2) a polyisocyanate compound and (B-1) a water-insoluble or sparingly water-soluble fluorine-containing surface-active agent, and heat-treating the pre-sheet at a temperature of 40 to 80° C. to promote the crosslinking reaction between the saturated polyester and the polyisocyanate and the migration of the fluorine-containing surface-active agent to the surface of the layer.

The water-insoluble or sparingly water-soluble surface-active agent (B-1) included in the composition for producing the pre-sheet may be the same as described above. Surface-active agents (B-1) having an HLB value of 5 to 7 in particular separates from the saturated polyester and the polyisocyanate and smoothly migrates on the surface when the pre-sheet is heated to 40 to 80° C. If the HLB value of the surfactant (B-1) is less than 5, its compatibility with the saturated polyester (A-1) is greatly reduced. Hence, without heating, the surfactant migrate smoothly onto the surface with time although the migration is promoted by heating.

The composition comprising the components (A-1), (A-2) and (B-1) preferably contains the fluorine-containing surface active agent (B-1) in an amount of 2 to 15% by weight based on the saturated polyester (A-1). If this amount is less than 2% by weight, the formation of the non-tacky layer is insufficient, and the melt adhesion of the record sheet to the ink ribbon and poor travelling of the record sheet and the ink ribbon tend to occur. On the other hand, if it exceeds 15% by weight, the image density becomes lower, the printed image has reduced storage stability, and color migration increases at the time of thermal transfer. Consequently, the characteristics of the record sheet may be markedly impaired.

The saturated polyester (A-1) and the polyisocyanate compound (A-2) may be the same as described above.

The above composition may, as required, include an antistatic agent, an ultraviolet absorber, a fluorescent, a sticking-preventing agent, a wax, a filler, a matting agent or a surface tension adjusting agent.

To provide a layer of the above composition on the surface of the substrate sheet, the same method as described above for providing the dye receptive layer on the surface of the substrate sheet may be employed.

The layer of the composition formed on the surface of the substrate is heated at a temperature of 40 to 80° C. This heating promotes the crosslinking reaction between the saturated polyester and the polyisocyanate in the composition and at the same time, the migration of the fluorine-containing surface-active agent to the surface of the resulting layer.

It is believed that in the layer of the composition formed on the surface of the substrate, partial crosslinking reaction proceed between the saturated polyester and the polyisocyanate compound before it undergoes the above heat-treatment.

The heat-treatment is carried out at the above temperature desirably for several hours to several days, for example 5 hours to 4 days. If the treating temperature is less than 40° C., a complete non-tacky layer is difficult to form even when it is left to stand for a long period of time, and during the image transfer process, the resulting layer might melt-adhere to the ink ribbon. On the other hand, if it exceeds 80° C., the surface flatness of the resulting film is reduced, and the uniformity of the non-tacky layer is lost. Consequently, the density of the transferred image becomes non-uniform.

Instead of the above heat-treatment, a radiation treatment with infrared rays, far-infrared rays, electron beams or treatment in vacuum or under elevated pressure may be used.

The substrate sheet used in this invention may be, for example, various types of paper formed from cellulosic fibers, or films or synthetic paper-like sheets formed from plastic resins. A stretched film of an aromatic polyester is preferred from the viewpoint of heat resistance. In order to realize a high image density and a high resolution on the order of 10 micrometers and prevent deformation of the substrate sheet by heat at the time of image formation, the substrate sheet is especially preferably a stretched film of an aromatic polyester such as polyethylene terephthalate, polybutylene terephthalate or polyethylene-2,6-naphthalate.

The stretched aromatic polyester film can be formed by for example, melt-molding the aromatic polyester into an unstretched film, biaxially stretching the unstretched film and heat-setting the stretched film at high temperatures.

Polyester films usually have a film density of 1.35 to 1.42 g/cm$^3$. The polyester film used in this invention preferably has a lower density of 1.10 to 1.35 g/cm$^3$ as a result of including very fine voids.

The polyester film having fine voids therein may be produced, for example, by incorporating inert particles having an average particle diameter of not more than 10 micrometers in the polyester in an amount of preferably 3 to 30 parts by weight, more preferably 5 to 20 parts by weight, per 100 parts by weight of the polyester, melt-molding the resulting polyester into a stretched film, and biaxially stretching the unstretched film. By the stress caused by the biaxial stretching, very fine inner voids are formed around the particles.

Examples of inert particles that can be conveniently used in the present invention include inorganic particles such as particles of silica, kaolin, talc, clay, calcium carbonate, barium carbonate, magnesium carbonate, titanium oxide and aluminum sulfate, and orgnaic particles such as particles of high-density polyethylene, polypropylene, benzoguanamine, crosslinked polystyrene and silicones.

The above polyester is preferably polyethylene terephthalate, polybutylene terephthalate, or polyethylene -2,6-naphthalate.

The polyester film having very fine inner voids has a density of 1.10 to 1.35 g/cm$^3$. The above film density is considerably low in view of the fact that commercial polyester films (biaxially oriented) generally have a density of about 1.40 g/cm$^3$. The size, number, etc. of the very fine inner voids formed in the film are difficult to measure directly on an industrial scale, and therefore, they are indirectly evaluated by the density of the film.

If the film density is lower than 1.10 g/cm$^3$, the fine voids are too many and the heat resistance and mechanical strength of the film are degraded. Hence, the film loses desirable properties for use as a recording material. If the film density is higher than 1.35 g/cm$^3$, the heat insulating action of the film is low, and the heat of the thermal head at the time of printing tends to escape to the sheet, and is not effectively used for the sublimation of the dye. Consequently, the image density is difficult to increase.

The polyester film may be singly used. As required, however, two such polyester sheets may be bonded together, or the polyester film is bonded to another substrate such as plain paper, coated paper, a paper-like synthetic sheet, a film or a metal foil to use the bonded structure as the substrate sheet. It is also possible to use coated paper, art paper, a paper-like synthetic sheet, and plastic sheets such as a polyvinyl chloride or polypropylene sheets as the substrate sheet either singly or in combination. These additional substrate sheet may sometimes result in a slightly inferior resolution as compared with the polyiester substrate, but give equally superior image densities and image stability.

The thickness of the substrate sheet is usually 25 to 500 micrometers.

The thermal transfer record sheet of this invention can be transferred and printed smoothly without melt-adhesion to the ink ribbon at the time of printing by the heating of the thermal head, and permits the formation of an image which attains a high density and has a resolution and clearness like a photograph. After printing, the resulting image is stably protected by the strong chemical bond between the non-tacky layer inhibiting diffusion and migration of the dye and the dye molecules in the dye receptive layer, and withstands storage for an extended period of time.

The following examples illustrate the invention more specifically. All parts in these examples are by weight. The thickness of the non-tacky layer is determined by measuring absorption intensities of Si, F and C atoms at varying irradiation angles in ESCA, and finding the thickness of the layer by using a calibration curve showing the relation between the absorption intensities and the thickness of the non-tacky layer. (This method will be referred to as the ESCA varying angle method.)

EXAMPLE 1

(1) Polyethylene terephthalate having an inherent viscosity (measured in o-chlorophenol at 35° C.) of 0.62 and containing 15.0% by weight of calcium carbonate having an average particle diameter of 2.5 micrometers and 3.0% by weight of titanium oxide having an average particle diameter of 0.3 micrometer was melted at 285° C., and extruded onto a quenching drum at 50° C. The resulting sheet was stretched longitudinally to 3.5 times at 80° C., and then transversely to 3.4 times at 110° C. to form a film having a density of 1.20. The film was used as a substrate.

(2) Separately, an ester-interchange reaction vessel was charged with 81.5 parts of dimethyl terephthalate, 110.4 parts of dimethyl isophthalate, 45.5 parts of ethylene glycol, 20.2 parts of neopentyl glycol, 144 parts of 2,2-bis(4-hydroxyethoxyphenyl)propane, 0.05 part of antimony oxide and 0.05 part of zinc acetate dihydrate. Elevation of the temperature of the reaction system was started. When the temperature of the mixture in the reaction vessel reached 170° C., evaporation of methanol began. When the reaction was performed for about 5.0 hours, methanol was evaporated in an amount of about 95% of theory. Then, the temperature of the reaction mixture in the reaction vessel was elevated, and when it reached 220° C., 0.5 part of trimethyl phosphate was added. The reaction mixture was then sent to a polymerization reaction vessel in an inert atmosphere.

The temperature of the reaction mixture received in the polymerization reaction vessel was 221° C. Elevation of the temperature was started immediately after the reaction mixture was received in the reaction vessel. In 45 minutes, the temperature reached 258° C. The reaction up to this point was carried out under atmospheric pressure When the temperature of the reaction mixture inside the reaction vessel reached 260° C., the degree of vacuum in the inside of the vessel was lowered to an absolute pressure of 0.3 mmHg over 30 minutes and the temperature of the reaction mixture was elevated to 275° C. Ethylene glycol and other glycols were evaporated. In this state, the polycondensation reaction was continued for about 2 hours to give a viscous saturated polyester having an inherent viscosity of 0.58 and a glass transition temperature of 73° C.

The saturated polyester was dissolved under heat in a mixture of 30 parts of methyl ethyl ketone and 70 parts of toluene to obtain a polyester resin solution having a solids concentration of 20% by weight.

(3) One hundred parts of the polyester solution, 2 parts of a modified isocyanate (Coronate L, solids content 75%; a product of Japan Polyurethane Industry Co., Ltd.), 0.05 part of fine silica (Aerosil R972, a product of Japan Aerosil), 0.8 part of polyether-modified dimethylpolysiloxane (BYK-306, a product of BYK Chemie), 20 parts of methyl ethyl ketone, 20 parts of toluene and 5 parts of cyclohexane were mixed with stirring for 30 minutes to prepare a coating solution for a dye receptive layer. This coating solution had a viscosity of 22 seconds (Zahn Cup #2, 25° C.).

(4) The resulting coating solution was coated by a reverse roll coater on one surface of the polyester substrate sheet so that the amount of the coating became 3 g/m$^2$ after drying to form a dye receptive layer having a thickness of 3.1 micrometers.

Then, 1.0 part of a polyoxyethylene ethanol adduct of perfluorocarbonsulfonic acid (SURFLON S-145; solids content 30%; a product of Asahi Glass Co., Ltd.) was dissolved in 500 parts of methanol, 1,000 parts of isopropanol and 500 parts of hexane to prepare a coating solution for a non-tacky layer. The resulting coating solution was coated on the dye receptive layer by a microgravure coater so that the amount of the coating before drying was 1.0 g/m$^2$. The coated substrate was then passed through an oven at 110° C. to dry it. The thickness of the non-tacky layer formed after drying was 120 angstrom by the ESCA varying angle method.

A sample piece, 10 cm×12.7 cm, was cut out from the resulting thermal transfer record sheet, and mounted on a sublimation-type printer (Hitachi Video Printer VY-100; the ink ribbon S-100). A gradation pattern was printed on the sample piece under the following thermal transfer recording conditions.

Thermal Head Conditions

Dot density: 6 dots/mm
Printing voltage: 11.5V
Applied pulse duration: variable

The pattern was smoothly printed without melt-adhesion, unusual transfer or poor travelling. The image obtained had excellent clearness and a high density, as shown in Table 1.

In an atmosphere kept at 60° C. and a relative humidity of 85%, the printed sample piece was superimposed on a piece of coated paper while applying a pressure of 6 kg/cm$^2$, and the state of color migration was examined. There was little blurring, color fading and transfer of the image, and the recorded sheet showed very good image storage stability.

EXAMPLE 2

A record sheet was prepared by the same procedure as in Example 1 except that a polyester resin obtained by reacting 117.4 parts of dimethyl terephthalate, 76.6 parts of dimethyl isophthalate, 61.8 parts of ethylene glycol and 148.2 parts of 2,2-bis -(4-hydroxyethoxyphenyl)propane was used as the polyester component of the dye receptive layer. The resulting record sheet was tested in the same way as in Example 1. Melt-adhesion, unusual transfer and poor traveling did not occur, and a clear image of a high density was obtained.

EXAMPLE 3

A coating solution for a dye receptive layer was prepared from 100 parts of the polyester resin solution, 2.5 parts of a modified isocyanate (Takenate A-12, solids content 60%, a product of Takeda Chemical Co., Ltd.), 0.2 part of an ultraviolet absorber (JUNOX 2000, a product of Morisawa Co., Ltd.), 1.2 parts of polyether-modified dimethylsiloxane (BYK-30, a product of BYK-Chemie), 5.5 parts of a perfluorocarbon ester (FC-431, solids content 50%, a product of Sumitomo 3M), 20 parts of methyl ethyl ketone, 25 parts of toluene and 5 parts of cyclohexanone in accordance with Example 1.

The resulting coating solution was coated on the same substrate sheet as in Example 1, and then, n-hexane was coated on the dye receptive layer so that the thickness of the coating before drying became 3 g/m$^2$. The coating was dried at 80° C. for 1 minute to allow the perfluorocarbon ester and the polyether-modified dimethylpolysiloxane to migrate onto the surface of the dye receptive layer. The thickness of the non-tacky layer, measured by the ESCA varying angle method, was 80 angstrom.

The resulting sheet was tested by the same method as in Example 1. There was no melt-adhesion, unusual transfer nor poor travelling, and a clear image having a high density and excellent storage stability was obtained.

EXAMPLE 4

A coating solution for a dye receptive layer was prepared from 100 parts of a solution of the same polyester resin as used in Example 2, 2 parts of a modified isocyanate (N-3030, solids content 60%, a product of Japan Polyurethane Indust Co , Ltd ), 0.2 part of an ultraviolet absorber (Viosorb® 550, a product of Kyodo Chemicals), 20 parts of methyl ethyl ketone, 25 parts of toluene and 5 parts of cyclohexanone. The coating solution was coated by a reverse roll coater on the same polyester substrate sheet as obtained in Example 1 so that the amount of the coating after drying was 3.5 g/m$^2$. The resulting dye receptive layer had a thickness of 3.8 micrometers.

An n-hexane solution (solids concentration 0.01%) of perfluorocarbon ester (FC-430, solids content 100%, a product of Sumitomo 3M) was spray-coated on the dye receptive layer so that the amount of the coating before drying was 2 g/m$^2$. The coated material was passed through a drying oven at 80° C. to evaporate the solvent and form a non-tacky layer which by the ESCA varying angle method, had a thickness of 155 angstrom.

The resulting record sheet was evaluated by the same method as in Example 1 A clear image of a high density was obtained without the occurrence of melt-adhesion, unusual transfer and poor travelling.

EXAMPLE 5

A record sheet was prepared as in Example 1 except that the fine particles included in the polyethylene terephthalate were changed to 12.5% by weight of barium sulfate having an average particle diameter of 4.2 micrometers and 2.5% by weight of titanium dioxide having an average particle diameter of 0.3 micrometer. The record sheet was evaluated by the same method as in Example 1. A clear image of a high density was obtained without the occurrence of melt-adhesion, unusual transfer and poor travelling.

COMPARATIVE EXAMPLE 1

A record sheet was formed in which the dye receptive layer comprised a polyester resin not containing a bisphenol A skeleton.

Specifically, 104.8 parts of dimethyl terephthalate, 89.2 parts of dimethyl isophthalate, 47.5 parts of ethylene glycol and 62.4 parts of neopentyl glycol were reacted in the same way as in Example 1 to give a saturated polyester resin having an inherent viscosity of 0.63 and a glass transition temperature of 67° C. The record sheet was prepared as in Example 1 except that this polyester resin was used as a dye receptive layer forming component. The record sheet was evaluated in the same way as in Example 1. The image density was low, and in particular, the gradation of the image at a low density and the maximum density of the printed image in a high temperature atmosphere were insufficient.

COMPARATIVE EXAMPLE 2

A polyester resin having an inherent viscosity of 0.61 and a glass transition temperature of 58° C. was prepared by reacting 73.7 parts of dimethyl terephthalate, 120.3 parts of dimethyl isophthalate, 47.2 parts of ethylene glycol, 58.5 parts of neopentyl glycol and 15.2 parts of 2,2'-bis(4-hydroxyethoxyphenyl)propane. A record sheet was prepared by the same method as in Example 1 by using the resulting polyester as a dye receptive layer forming component. Printing was carried out as in Example 1 by using the resulting sheet. The image density was generally on a good level. But in an atmosphere kept at 60° C. and a relative humidity of 80%, color migration and blurring were great, and the image had insufficient storage stability.

COMPARATIVE EXAMPLE 3

A record sheet was prepared by the same method as in Example 1 except that the modified isocyanate (Coronate L) was not used in the preparation of the coating solution for the dye receptive layer. The sheet was subjected to the same test as in Example 1. The image density was good But in an atmosphere kept at 60° C. and a relative humidity of 80%, color migration and blurring were great, and the image had insufficient storage stability. The adhesion of the coated layers was also insufficient.

COMPARATIVE EXAMPLES 4–5

Example 1 was repeated except that the thickness of the non-tacky layer was changed to 250 angstrom (Comparative Example 4) and 20 angstrom (Comparative Example 5). The record sheet obtained in Comparative Example 5 melt-adhered to the ink ribbon at a cyan color portion, and the travelling of the record sheet and the ink ribbon was poor. In the record sheet obtained in Comparative Example 4, the image was printed with good reproducibility. But in an atmosphere kept at 60° C. and a relative humidity of 80%, color migration was remarkable, and the sheet was not practical.

The results obtained in the foregoing Examples and Comparative Examples are shown in Table 1. The methods of evaluation in these and other examples were as follows:

(1) Printing Characteristics

A sample piece in a size of 10 cm×12.7 cm was cut out from each of the thermal transfer record sheets prepared. The sample piece was set on a sublimation-type printer (Hitachi Video Printer VY-100; the ink ribbon S100), and a gradation pattern was printed on the sample piece under the following thermal recording conditions.

Thermal Head Conditions

Dot density: 6 dots/mm
printing voltage 11.5V
Applied pulse duration: variable

When there was no melt-adhesion between the record sheet and the ink ribbon, unusual transfer nor poor travelling, the evaluation was ○. When even a slight trouble occurred, the evaluation was X.

(2) Image Characteristics

The density of the image on the recorded sample piece was measured by a MacBeth densitometer (RD-918), and changes in density corresponding to the printing pulse durations are evaluated as gradation. The maximum density of the image was indicated as the image density, and the gradation is evaluated as the inclination of the density corresponding to the pulse duration. High numerical values represent "good". The clearness of the image was evaluated by ○ which means that dots in a fine line portion observed under a microscope were uniform and continuous; Δ which means that the dots were partly defective; and X which means that the dots were non-uniform and discontinuous.

(3) Color Migration

The printed sample was superimposed on a piece of coated paper (OK Coat supplied by Oji Papermaking Co., Ltd.), and the assembly was left to stand in an atmosphere kept at a temperature of 60° C. and a relative humidity of 80% for 24 hours under a load of 6 kg/cm$^2$. The density of the dye transferred to the coated paper after standing was measured by a MacBeth densitometer (RD-918). It was determined that a high density means poor color migration, and a low density, good color migration.

Blurring was evaluated by ○ which means that by microscopic observation of a 50% halftone gray scale portion, the dots are aligned with a uniform size; Δ which means that the dots are slightly defective; and X which means that the dots were nonuniform, and the boundaries are obscure.

(4) Color Fading

Light from a carbon arc (Sunsine Fade-O-Meter, SEL-1 supplied by Suga Testing instrument Co., Ltd.) was applied to the surface of the printed sample. Twenty-four hours later, the ratio of fading of the cyan density was measured Small values mean good color fading resistance, and large values mean poor color fading resistance.

TABLE 1

| | | Example | | | | | Comparative Example | | | | |
|---|---|---|---|---|---|---|---|---|---|---|---|
| | | 1 | 2 | 3 | 4 | 5 | 1 | 2 | 3 | 4 | 5 |
| Printing characteristics | Melt-adhesion | ○ | ○ | ○ | ○ | ○ | ○ | ○ | ○ | ○ | X |
| | Unusual transfer | ○ | ○ | ○ | ○ | ○ | ○ | ○ | ○ | ○ | X |
| | Poor travelling | ○ | ○ | ○ | ○ | ○ | ○ | ○ | ○ | ○ | X |
| Image characte- | Density | 1.78 | 1.72 | 1.79 | 1.82 | 1.77 | 1.38 | 1.68 | 1.75 | 1.60 | — |
| | Gradation | 0.13 | 0.12 | 0.12 | 0.13 | 0.12 | 0.10 | 0.11 | 0.11 | 0.11 | — |

TABLE 1-continued

| | | Example | | | | | Comparative Example | | | | |
|---|---|---|---|---|---|---|---|---|---|---|---|
| | | 1 | 2 | 3 | 4 | 5 | 1 | 2 | 3 | 4 | 5 |
| ristics | Clearness | ○ | ○ | ○ | ○ | ○ | ○ | ○ | Δ | Δ | — |
| Storage | Blurring | ○ | ○ | ○ | ○ | ○ | ○ | X | X | X | — |
| stability | Color migration | ○ | ○ | ○ | ○ | ○ | ○ | X | X | X | — |
| | Color fading | 7.8 | 8.5 | 3.2 | 4.2 | 7.5 | 10.1 | 59.8 | 48.0 | 38.6 | — |

Note: The mark "—" means that the measurement was not made.

EXAMPLE 6

(1) Polyethylene terephthalate having an inherent viscosity (measured in o-chlorophenol at 35° C.) of 0.60 containing 8.0% by weight of calcium carbonate having an average particle diameter of 0.5 micrometer and 3.0% of titanium dioxide having an average particle diameter of 0.3 micrometer was melted at 285° C., and extruded onto a quenching drum at 50° C. The resulting sheet was stretched longitudinally to 3.5 times at 80° C. and then transversely to 3.4 times at 110° C., and then heat-set to give a polyester film having a thickness of 125 micro-meters and a density of 1.40. This film was used as a substrate.

(2) A coating solution was prepared by mixing 100 parts by weight of the same polyester resin solution as obtained in Example 1, (2), 2.4 parts of a modified isocyanate (Coronate® 2030, solids content 50%, Japan Polyurethane Industry Co., Ltd.), 7.5 parts of a polyoxyethylene ethanol adduct of perfluorocarbon (SURFLON S-145, solids content 30%, Asahi Glass Co., Ltd.), 0.05 part of fine silica (Aerosil R972, Japan Aerosil), 20 parts of methyl ethyl ketone, 25 parts of toluene and 5 parts of cyclohexanone, and stirring the mixture for 30 minutes. The coating solution had a viscosity of 23.5 seconds (Zahn Cup #2, 24° C.).

(3) The coating solution was coated on one surface of the polyester substrate sheet by a reverse roll coater so that the amount of the coating after drying was 3 g/m$^2$. The resulting coated layer had a thickness of 3.1 micrometers. The coated film in roll form was left to stand for 72 hours in a dryer at 50° C. to heat-treat it. After the heat-treatment, the thickness of the non-tacky layer on the surface of the dye receptive layer was measured by the ESCA varying angle method and found to be 145 angstrom.

A sample piece, 10 cm×12.7 cm, was cut out from the resulting thermal transfer record sheet, and mounted on a sublimation-type printer (Hitachi Video Printer VY-100; the ink ribbon S-100). A gradation pattern was printed on the sample piece under the following thermal transfer recording conditions.

Thermal Head Conditions

Dot density: 6 dots/mm
Printing voltage: 11.5V
Applied pulse duration: variable

The pattern was smoothly printed without melt-adhesion, unusual transfer or poor travelling. The image obtained had excellent clearness and a high density, as shown in Table 2.

The printed sample was superimposed on a piece of coated paper under a pressure of 6 kg/cm$^2$ in an atmosphere kept at a temperature of 60° C. and a relative humidity of 85%, and the state of color migration was examined. The image was free from blurring, color fading and transfer, and showed very good storage stability.

EXAMPLE 7

Example 6 was repeated except that 6.0 parts of an ester of fluorocarbon (Fluorad FC-431, solids content 50%; a product of Sumitomo 3M) was used instead of the polyoxyethylene ethanol adduct of perfluorocarbon in the preparation of the coating solution. When the resulting record sheet was tested as in Example 6, a clear image having a high density was obtained without the occurrence of melt-adhesion, unusual transfer and poor travelling.

EXAMPLE 8

Example 6 was repeated except that the same polyester resin as used in Example 2 was used in the preparation of the coating solution. When the resulting record sheet was tested as in Example 6, a clear image having a high density was obtained without the occurrence of melt-adhesion, unusual transfer and poor travelling.

EXAMPLE 9

A record sheet was prepared by the same procedure as in Example 6 except that the same coating solution as prepared in Example 3 was used. The thickness of the non-tacky layer, measured by the ESCA varying angle method, was 80 angstrom.

The record sheet was tested as in Example 6. It was free from melt-adhesion, unusual transfer and poor travelling and showed excellent storage stability, and a clear image having a high density was obtained.

EXAMPLE 10

A coating solution was prepared by mixing 100 parts of a solution of the same polyester resin as used in Example 6, 2 parts of a modified isocyanate (N-3030, solids content 60%, a product of Japan Polyurethane Industry Co., Ltd.), 10 parts of a polyoxyethylene ethanol adduct of perfluorocarbon (SURFLON S-145, solids content 30%, Asahi Glass Co., Ltd.), 0.2 part of an ultraviolet absorber (Viosorb 550, a product of Kyodo Chemicals), 20 parts of methyl ethyl ketone, 25 parts of toluene and 5 parts of cyclohexanone. The resulting coating solution was coated by a reverse roll coater on a transparent polyester film (Teijin Tetoron® Film HS Type, 100 microns) so that the amount of the coating after drying was 3.0 g/m$^2$. The thickness of the coated layer was 2.8 micrometers. The coated sheet was left to stand for 30 seconds in an oven at 70° C. and maintained in roll form in an atmosphere kept at 40° C. for 2 days.

The record sheet was tested as in Example 6. A clear image having a high density was obtained without the occurrence of melt-adhesion, unusual transfer and poor travelling.

EXAMPLE 11

A record sheet was prepared as in Example 6 except that 11.0% by weight of titanium dioxide having an average particle diameter of 0.3 micrometer was incorporated as fine particles in polyethylene terephthalate. The resulting record sheet was tested as in Example 6. A clear image having a high density was obtained without the occurrence of melt-adhesion, unusual transfer and poor travelling.

COMPARATIVE EXAMPLE 6

A record sheet having a dye receptive layer comprising a polyester resin free from a bisphenol A skeleton was prepared.

Specifically, the record sheet was prepared by the same method as in Example 6 except that the same saturated polyester resin as used in Comparative Example 1 was used in the coating solution. The image density was low, and in particular, the gradation of the image at a low density and the maximum density of the printed image in a high-temperature atmosphere were insufficient.

COMPARATIVE EXAMPLE 7

A record sheet was prepared as in Example 6 except that the same saturated polyester as used in Comparative Example 2 was used in the coating solution. When printing was carried out on the resulting sheet, the image density was generally on a good level. But in an atmosphere kept at a temperature of 60° C. and a relative humidity of 80%, color migration and blurring were great, and the storage stability of the image was insufficient.

COMPARATIVE EXAMPLE 8

A record sheet was prepared by the same method as in Example 6 except that the modified isocyanate was not used in the preparation of the coating solution. The resulting sheet was tested as in Example 6. The image density was good. But in an atmosphere kept at a temperature of 60° C. and a relative humidity of 80%, color migration and blurring were great, and the storage stability of the image was insufficient. The adhesion of the coated layer was insufficient, too.

COMPARATIVE EXAMPLE 9

A record sheet was prepared by the same method as in Example 6 except that the polyoxyethylene ethanol of perfluorocarbon (SURFLON S-145, solid content 30%, Asahi Glass Co., Ltd.) was not used in the preparation of the coating solution. The resulting sheet was heat-treated and then tested as in Example 6. The ink ribbon stuck to the sheet, and could not travel. Hence, printing could not be performed.

TABLE 2

| | | Example | | | | | | Comparative Example | | | |
|---|---|---|---|---|---|---|---|---|---|---|---|
| | | 6 | 7 | 8 | 9 | 10 | 11 | 6 | 7 | 8 | 9 |
| Printing characteristics | Melt-adhesion | ○ | ○ | ○ | ○ | ○ | ○ | ○ | ○ | Δ | X |
| | Unusual transfer | ○ | ○ | ○ | ○ | ○ | ○ | ○ | ○ | X | X |
| | Poor travelling | ○ | ○ | ○ | ○ | ○ | ○ | ○ | ○ | ○ | X |
| Image characteristics | Density | 1.80 | 1.78 | 1.75 | 1.72 | 1.62 | 1.69 | 1.40 | 1.68 | 1.65 | — |
| | Gradation | 0.13 | 0.12 | 0.12 | 0.10 | 0.05 | 0.10 | 0.10 | 0.11 | 0.12 | — |
| | Clearness | ○ | ○ | ○ | ○ | ○ | ○ | ○ | ○ | Δ | — |
| Storage stability | Blurring | ○ | ○ | ○ | ○ | ○ | ○ | ○ | X | X | — |
| | Color migration | ○ | ○ | ○ | ○ | ○ | ○ | ○ | X | X | — |
| | Color fading | 7.5 | 8.0 | 4.3 | 4.1 | 3.2 | 6.9 | 10.4 | 59.8 | 45.9 | — |

Note: The mark "—" means that the measurement was not made.

We claim:

1. A process for producing a thermal transfer record sheet comprising a substrate sheet and a dye receptive layer and a non-tacky layer in this order on at least one surface of the substrate sheet; the dye receptive layer being composed of a crosslinking reaction product of a composition comprising (A-1) a saturated polyester, containing units derived from 2, 2-bis(4-hydroxyphenyl)propane in the main chain of the polyester and having a glass transition temperature of at least 60° C. and (A-2) a polyisocyanate compound, and the non-tacky layer (B-1) comprising a water-insoluble or sparingly water-soluble fluorine-containing surface-active agent and (B-2) having a thickness of 50 to 200 angstrom, which comprises heat-treating a pre-sheet comprising the substrate sheet and on at least one surface thereof, a layer composed of the partial crosslinking reaction product of a composition comprising (A-1) the saturated polyester (A-2) the polyisocyanate compound and (B-1) the water-insoluble or sparingly water-soluble fluorine-containing surface-active agent, at a temperature of 40 to 80° C. to promote the crosslinking reaction between the saturated polyester and the polyisocyanate and to promote the migration of the fluorine-containing surface-active agent onto the surface of the dye receptive layer.

2. A process for producing the thermal transfer record sheet of claim 1, in which the amount of the fluorine-containing surface-active agent is 2 to 15 parts by weight per 100 parts by weight of the saturated polyester.

* * * * *